United States Patent [19]

Terrell et al.

[11] Patent Number: 4,889,187

[45] Date of Patent: Dec. 26, 1989

[54] MULTI-RUN CHEMICAL CUTTER AND METHOD

[75] Inventors: Jamie B. Terrell; Donna P. Terrell, 1916 Christopher Dr., Forth Worth, Tex. 76140; Setella Parks, Longview, Tex.

[73] Assignees: Jamie Bryant Terrell; Donna Pratt Terrell, both of Forth Worth, Tex.

[21] Appl. No.: 185,877

[22] Filed: Apr. 25, 1988

[51] Int. Cl.[4] ..... E21B 29/02

[52] U.S. Cl. ..... 166/298; 166/55; 166/242; 166/376

[58] Field of Search ..... 166/298, 297, 55, 242, 166/376, 237, 240, 223

[56] References Cited

U.S. PATENT DOCUMENTS

| | | | |
|---|---|---|---|
| 2,680,483 | 6/1954 | LeBus | 166/298 |
| 3,321,016 | 5/1967 | Lance | 166/237 |
| 3,552,492 | 1/1971 | Mullins | 166/237 |
| 4,250,960 | 2/1981 | Chammas | 166/55 |
| 4,355,685 | 10/1982 | Beck | 166/240 |
| 4,620,591 | 11/1986 | Terrell et al. | 166/55 |
| 4,625,799 | 12/1986 | McCormick | 166/312 |
| 4,705,107 | 11/1987 | Council et al. | 166/223 |

FOREIGN PATENT DOCUMENTS

| | | | |
|---|---|---|---|
| 0757692 | 8/1980 | U.S.S.R. | 166/298 |

*Primary Examiner*—Jerome W. Massie
*Assistant Examiner*—Terry Lee Melius
*Attorney, Agent, or Firm*—Richards, Medlock & Andrews

[57] ABSTRACT

Disclosed are a method and an apparatus for cutting conduits. The apparatus includes a cutting head adapted for insertion in the conduit. The cutting head has at least one nozzle. The cutting head is rotatable to locate a previously cut sector of the conduit. A decentralizer is provided for positioning the nozzle adjacent a portion of the conduit.

21 Claims, 6 Drawing Sheets

MULTI-RUN CHEMICAL CUTTER AND METHOD

BACKGROUND OF THE INVENTION

A. Field of the Invention

The present invention relates generally to methods and apparatus for cutting or perforating objects and more particularly to apparatus and methods for chemically cutting objects within a well bore by making multiple cuts with fluid jets.

B. Description of the Prior Art

Chemical cutting devices or tools are well-known within the art and are frequently used to cut, sever, perforate or slot objects within a well bore. Such objects may include metal pipe, well bore casing, earth formations, or foreign objects such as lost tools which may be found within the well bore. Chemical cutting is advantageous in downhole situations because it does not produce debris that must be removed from the hole and it does not flare the cut end of the pipe.

Such known devices are typically tubular structures which enclose a chamber containing a cutting fluid that is extremely active chemically and which reacts violently when it is brought into contact with most oxidizing substances. Examples of such cutting fluids include fluorine, and halogen fluorides including such compounds as chlorine trifluoride, chlorine monofluoride, bromine trifluoride, bromine pentafluoride, iodine pentafluoride and iodine hexafluoride and mixtures thereof.

Generally, chemical cutting fluids are discharged in one or more high velocity streams or jets by applying to the chamber in which they are stored a suitable pressurizing agent. Pressurizing agents generally include hydraulic or pneumatic fluids. Pneumatic fluids may be gases generated by the ignition of one of the various types of relatively slow-burning gun powders or other explosives including black powder, rocket propellant powders, or the like. By appropriate selection of an explosive and by means of preparation procedures well-known to those skilled in the art, the ignition and burning rates of such explosives may be effectively controlled to generate gases at any desired rate and volume suitable for applying the desired pressurizing forces to the cutting fluid.

Typically, the chemical cutting is accomplished in a single "one shot" operation. If it is desired to completely sever a conduit within a well bore, a cutting tool having multiple discharge nozzles adapted to discharge radial jets of cutting fluid in all directions is disposed within the conduit. When the propellant is fired, the cutting tool is anchored in the conduit and the cutting fluid discharged through the nozzles severs the conduit. There are, however, certain limitations on the effectiveness of such tools. For example, the standoff distance for such tools is relatively short. Standoff is defined as one-half the difference in conduit internal diameter and cutting head outside diameter. Thus, the standoff is the radial distance between the cutting head and the inside of the conduit when the cutting head is centered in the conduit. The maximum effective standoff distance in chemical cutting tools is on the order of one-half inch or less. Thus, the outside diameter of the cutting head is optimally less than one inch smaller than the inside diameter of the conduit to be cut. The standoff constraint thus limits the ability of the tool to go through diameter restrictions and cut larger diameter conduits.

Additionally, there is a limit to the thickness of conduit that may be cut. During the cutting, substantial heat is generated. As the amount of cutting fluid is increased in order to cut thicker conduit, the amount of heat generated by the cutting is increased. During attempts to cut extremely thick conduit, the heat generated may become so great as to destroy the cutting tool itself.

SUMMARY OF THE INVENTION

It is therefore an object of the present invention to provide a method and apparatus for cutting conduit having large standoff relative to the cutting tool. It is a further object of the present invention to provide an apparatus and method for cutting relatively thick wall conduit.

Briefly stated, the foregoing and other objects of the present invention are accomplished by the tool of the present invention which includes a cutting head adapted to be inserted in a conduit. The cutting head includes at least one nozzle and the tool includes means for orienting the nozzle circumferentially with respect to a previously cut sector of the conduit. Decentralizer means are provided for positioning the nozzle radially adjacent a portion of the conduit and means are provided for discharging a quantity of cutting fluid from the nozzle to cut that portion. The orienting means preferably includes means for locating the previously cut sector and for rotating the cutting head to position the nozzle with respect to the previously cut sector. Thus, the tool of the present invention is adapted to make multiple circumferential cuts thereby to completely sever the conduit.

DESCRIPTION OF THE PREFERRED EMBODIMENT

Figure 1:
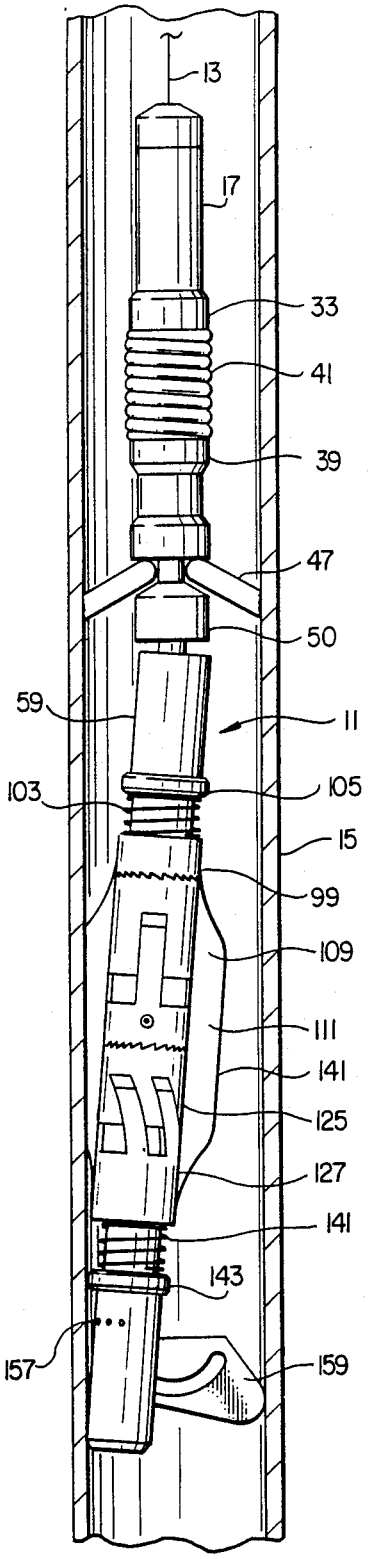
FIG. 1 is a side elevation view of the tool of the present invention in its intended environment.

Referring now to the drawings, and first to FIG. 1, the cutting tool of the present invention is designated generally by the numeral 11. Preferably, cutting tool 11 is adapted to be suspended and operated by a wireline 13 down hole in a oil field tubular member, as for example casing 15. While the preferred environment for the cutting tool of the present invention is down hole, the cutting tool may be used to cut other tubular members in other environments.

Figure 2A:
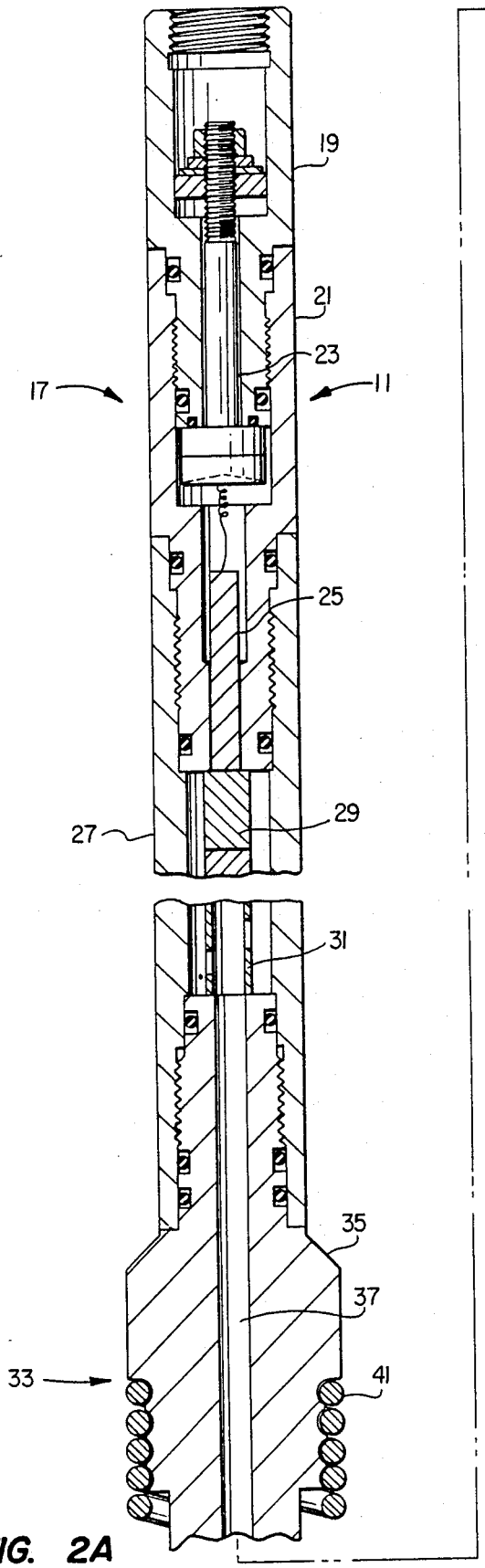
FIGS. 2A–2G, when placed end-to-end, form a sectional view of the tool of the present invention.

The details of the construction of the present invention are best shown in FIGS. 2A–2G and referring first to FIG. 2A, cutting tool 11 includes a fuze assembly designated generally by the numeral 17, which includes a firing adaptor body 19, which is adapted to make mechanical connection with the wireline rope socket (not shown) and a firing sub 21. Firing adaptor body 19 contains a contact rod 23, which is adapted to make electrical contact with the wireline to receive electrical firing signals and to transmit such signals to a fuze 25 contained within firing sub 21. Firing adaptor body 19 and firing sub 21 are threadedly connected together and are sealed by appropriate O-ring seals.

Firing sub 21 is connected to a tubular propellant assembly 27. Propellant assembly 27 is loaded with propellant 29. Propellant 29 is ignited by fuze 25 and those skilled in the art will appreciate that many types of propellant charge may be utilized to provide the pneumatic pressure necessary to operate cutting tool 11. Included among these propellants are any number of explosive materials that may be handled safely. Preferably, a propellant spacer 31 is utilized to smooth out the initial impact of the propellant within propellant assembly 27. Propellant assembly 27 is threadedly connected to firing sub 21 and the connection therebetween is sealed by appropriate O-ring seals.

Figure 2B:
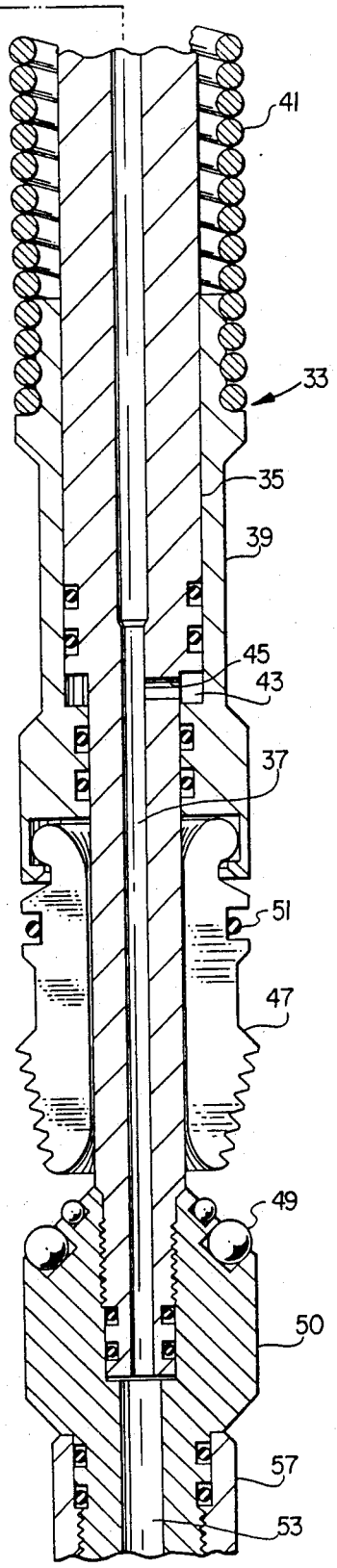

Referring particularly to FIGS. 2A and 2B, propellant assembly 27 is threadedly connected to a slip assembly, which is designated generally by the numeral 33. Slip assembly 33 includes a slip shaft 35 having a longitudinal passage 37 therethrough and a slip piston 39 slidingly mounted on slip shaft 35. Slip piston 39 is connected to slip shaft 35 by a tension spring 41. The ends of slip shaft 35 and slip piston 39 are threaded with a thread form matching tension spring 41 and tension spring 41 is threaded directly on to slip shaft 35 and slip piston 39. The threaded connection between tension spring 41 and slip shaft 35 and slip piston 39 allows the use of a large spring without increasing the outside diameter of the tool and it makes it easier to assemble the tool Tension spring 41 normally maintains slip piston 39 in an upward position, as shown in FIG. 2B.

An annular slip expansion chamber 43 is formed between slip piston 39 and slip shaft 35. Slip expansion chamber 43 receives gas generated by propellant 29 through a lateral passage 45 connecting slip expansion chamber 43 and longitudinal passage 37. Gas pressure within slip expansion chamber 43 causes slip piston 39 to move downwardly against the force of tension spring 41.

Slip piston 39 carries at its lower end a plurality of pivotally mounted slips 47. When propellant 29 is fired, slips 47 move downwardly with slip piston 39 and they are deflected radially outwardly by ball bearings 49 to engage the wall of casing 15, as shown in FIG. 1, and anchor cutting tool 11 in place. Ball bearings 49 are mounted in a bottom slip sub 50 threadedly engaged with slip shaft 35. Ball bearings 49 create a surface on which slips 47 ride and they eliminate the need to harden the upper surface of bottom slip sub 50. Bottom sub 50 has a longitudinal passage 53 which forms an extension of passage 37 of slip shaft 35.

Prior to firing of propellant 29, coiled spring 51 with its ends connected together is disposed about slips 47 to keep the slips from inadvertently moving outwardly with respect to slip shaft 35. After the pressure within slip expansion chamber 43 diminishes after firing, tension spring 41 pulls slip piston 39 back to the position shown in FIG. 2B to retract slips 47 to allow tool 11 to be withdrawn from casing 15.

Figure 2C:
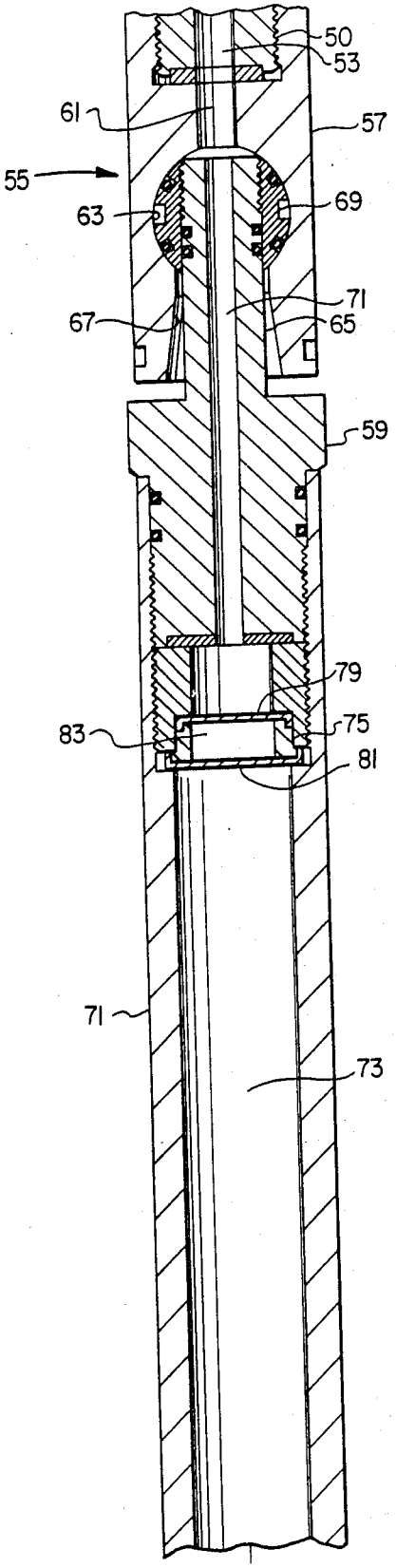

Referring now to FIG. 2C, cutting tool 11 includes a knuckle joint assembly 55, which includes a socket sub 57 threadedly engaged with bottom slip sub 50 and a ball sub 59. Socket sub 57 includes a longitudinal passageway 61 which forms an extension of passage 53 and an internal spherical socket 63. Ball sub 59 includes a neck 65 which extends into a flared passage 67 in socket sub 57. Neck 65 has connected to its end a ball 69 that is trapped within socket 63, whereby socket sub 59 is pivotal with respect to socket sub 57 in all directions limited by the flare of passageway 67. Ball sub 59 includes a longitudinal passageway which forms an extension of passage 61 of socket sub 57. Appropriate seals are provided for sealing between ball 69 and socket 63.

Referring still to FIG. 2C, below ball sub 59 there is positioned a first chemical module 71. First chemical module 71 includes a longitudinal chamber 73 which is sealed at its ends by dual diaphragm seal assemblies 75 and 77. Dual diaphragm seal assembly 75 includes an upper ruptureable membrane 79 and a lower ruptureable membrane 81, which are separated by a dead air space 83. The dual diaphragm seal serves to muffle the effect of propellant 29, which results in a smoother flow of chemical cutting agent.

Figure 2D:
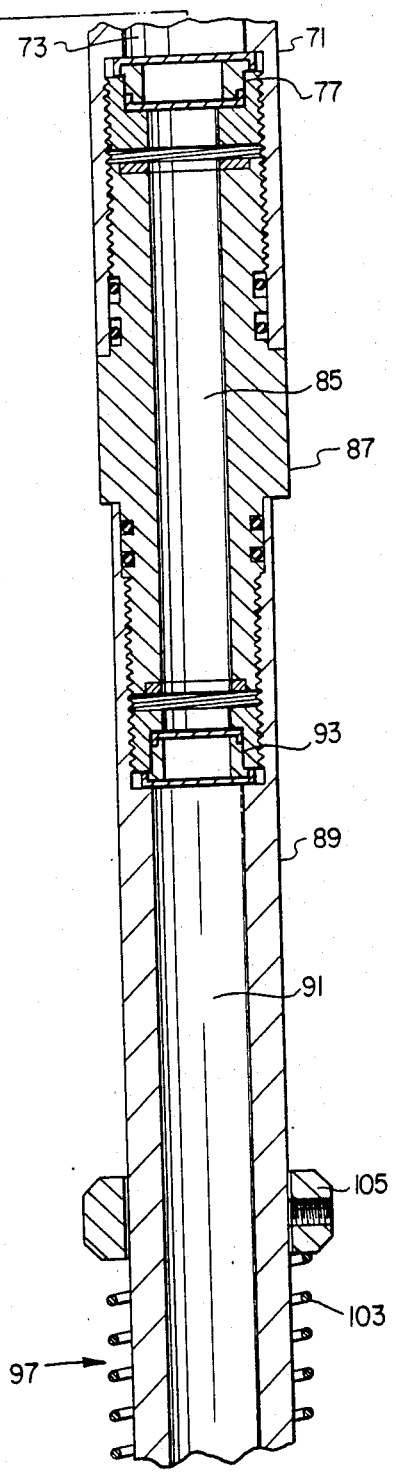
Figure 2E:
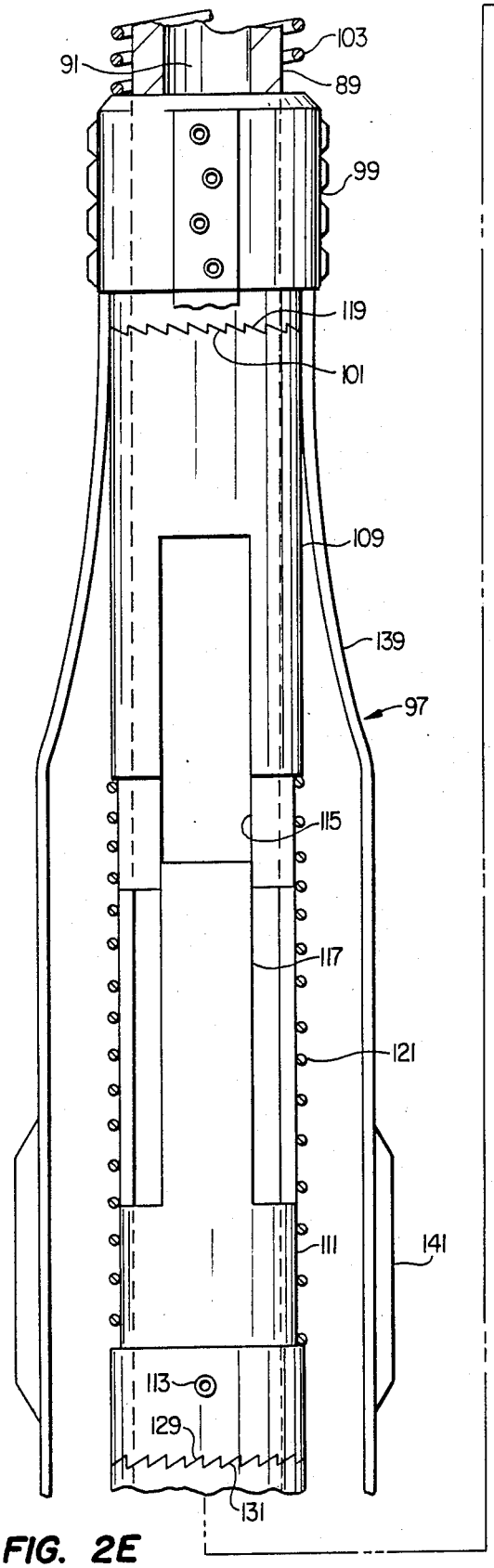
Figure 2F:
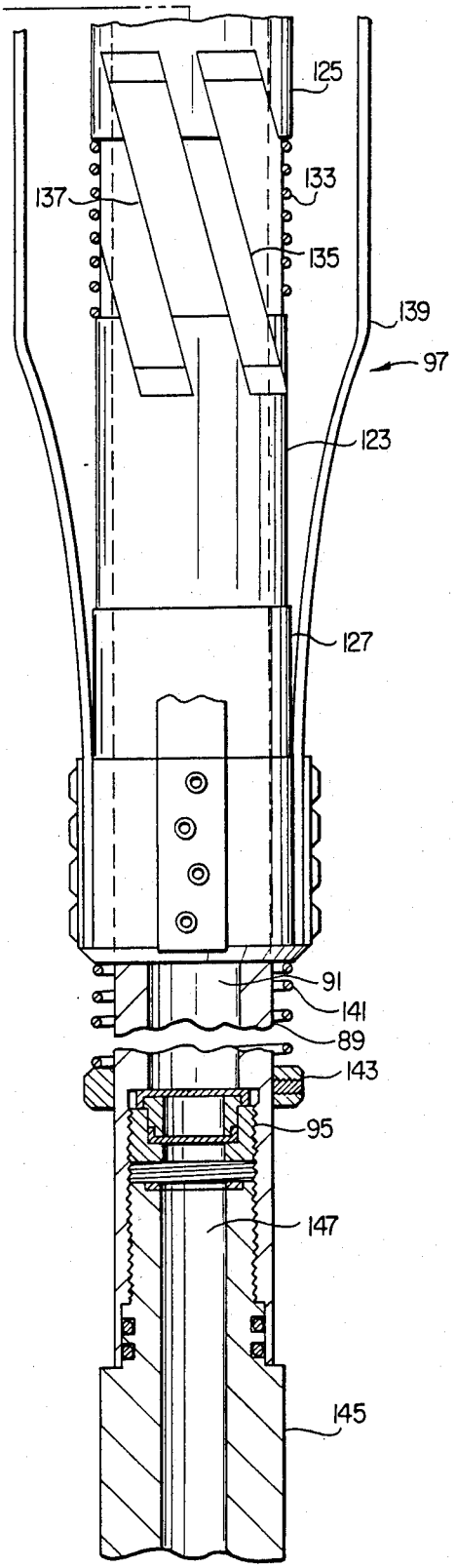
Figure 2G:
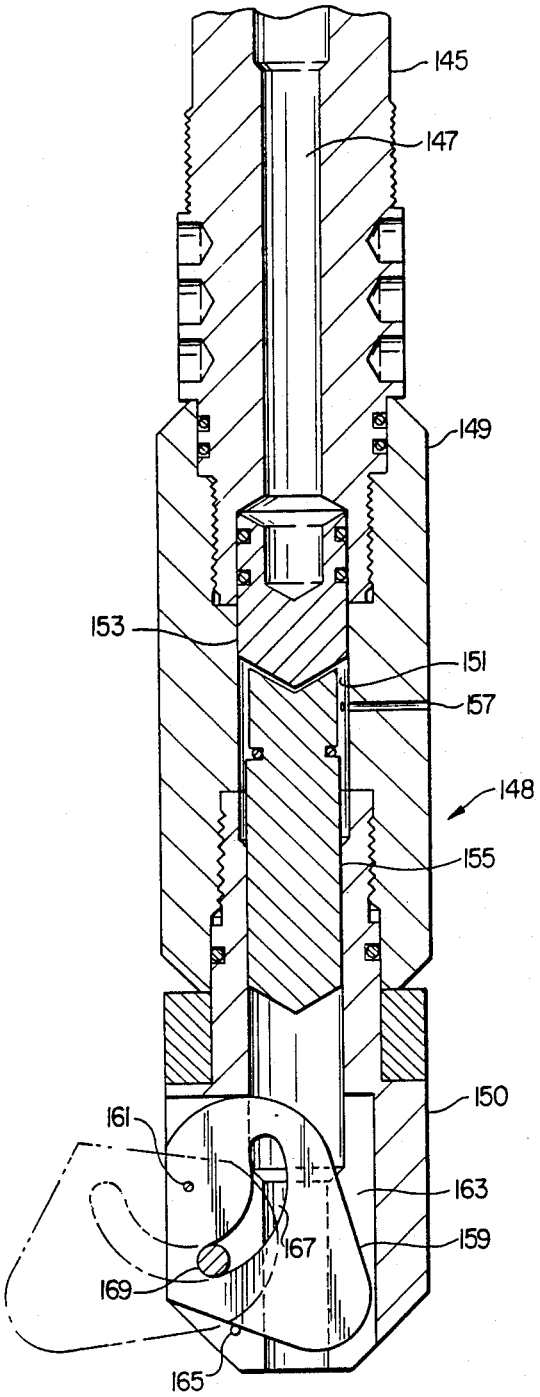

Chamber 73 contains a quantity of cutting fluid of the type described above. The ignition of propellant 49 causes dual diaphragm seal 75 to rupture and forces the fluid within chamber 73 to rupture dual diaphragm seal 77. The cutting fluid is then forced through a longitudinal passage 85 and a reducer sub 87. Reducer sub 87 is threadedly connected at one end to first chemical module 71 and at its other end to a second, reduced diameter, chemical module 89. As shown in FIGS. 2D–2F, second 89 includes a longitudinal chamber 91 that is sealed at its ends by dual diaphragm seals 93 and 95. Chamber 91 of second chemical module 89 contains a quantity of cutting fluid similar to that contained in chamber 73 of first chemical module 71.

Referring particularly to FIGS. 2D–2F, a centralizer assembly, designated generally by the numeral 97 is positioned about second chemical module 89. Rotating centralizer assembly 97 includes a ratchet collar 99 that is axially and rotatably mounted on second chemical module 89. The lower end of ratchet collar 99 includes a plurality of serated ratchet teeth 101. Ratchet collar 99 is urge downwardly with respect to second chemical module 89 by a spring 103 compressed between ratchet collar 99 and a retainer ring 105 connected to second chemical module 89.

Rotating centralizer assembly 97 also includes an axially splined sleeve assembly 107. Axially splined sleeve assembly 107 includes a first sleeve 109 slidingly mounted on second chemical module 89 and a second sleeve 111 fixedly connected to second chemical module 89 by a set screw or the like 113. First sleeve 109 and second sleeve 111 are connected together by axially extending splines, including, respectively, splines 115 and 117. Splines 115 and 117 engage each other and permit first and second sleeves 109 and 111 to move axially but not rotationally with respect to each other. Since second sleeve 111 is fixedly connected to second chemical module 89 by set screw 113, first sleeve 109 is permitted to move axially but not rotationally with respect to second chemical module 89.

The upper end of first sleeve 109 includes a plurality of serated ratchet teeth 119, which are configured to mesh with ratchet teeth 101 of ratchet collar 99. A spring 121 is disposed between shoulders formed on sleeves 109 and 111 to urge first sleeve 109 axially toward ratchet collar 99, thereby urging ratchet teeth 119 into engagement with ratchet teeth 101. It can be seen that ratchet teeth 101 and 119 permit first sleeve 109 to rotate toward the right but not toward the left with respect to ratchet collar 99.

Rotating centralizer assembly 97 also includes a helically splined sleeve assembly 123, which includes a first sleeve 125 and a second sleeve 127. First and second sleeves 125 and 127 of helically splined sleeve assembly 123 are axially and rotatably mounted on second chemical module 89. The upper end of first sleeve 125 includes a plurality of ratchet teeth 129 that have opposite pitch compared to ratchet teeth 101 and 119. Ratchet teeth 129 of second sleeve 127 are configured to mesh with a plurality of ratchet teeth 131 formed on the lower end of second sleeve 111 of axially splined sleeve assembly 107. A spring 133 is compressed between shoulders formed in first and second sleeves 125 and 127 of helically splined sleeve assembly 123 to urge ratchet teeth 129 into engagement with ratchet teeth 131. Ratchet 129 and 131 permit first sleeve 125 of helically splined sleeve assembly 123 to rotate toward the left but not toward the right with respect to second sleeve 111 of axially splined sleeve assembly 107.

First and second sleeves 125 and 127 are connected together by a plurality of helical splines, including, respectively, splines 135 and 137. Splines 135 and 137 engage each other such that axial movement of first and second sleeves 125 and 127 with respect to each other produces a rotary motion. Thus, when first sleeve 125 is moved toward second sleeve 127, splines 135 and 137 cooperate to rotate first sleeve 125 toward the right. Conversely, when first sleeve 125 is moved axially away from second sleeve 127, splines 135 and 137 cooperate to rotate first sleeve 125 toward the left.

Second sleeve 127 of helically splined sleeve assembly 123 is connected to ratchet collar 99 by a plurality of bow springs 139. Each bow spring 139 includes a wear pad 141 which is adapted to contact the inside wall of the casing to resist axial and rotational movement of ratchet collar 99 and second sleeve 127 of helically splined sleeve assembly 123. A spring 141 is compressed between second sleeve 127 and a retainer ring 143 connected to a second chemical module 89. Spring 141 urges second sleeve 127 axially upwardly with respect to second chemical module 89.

Figure 3A:
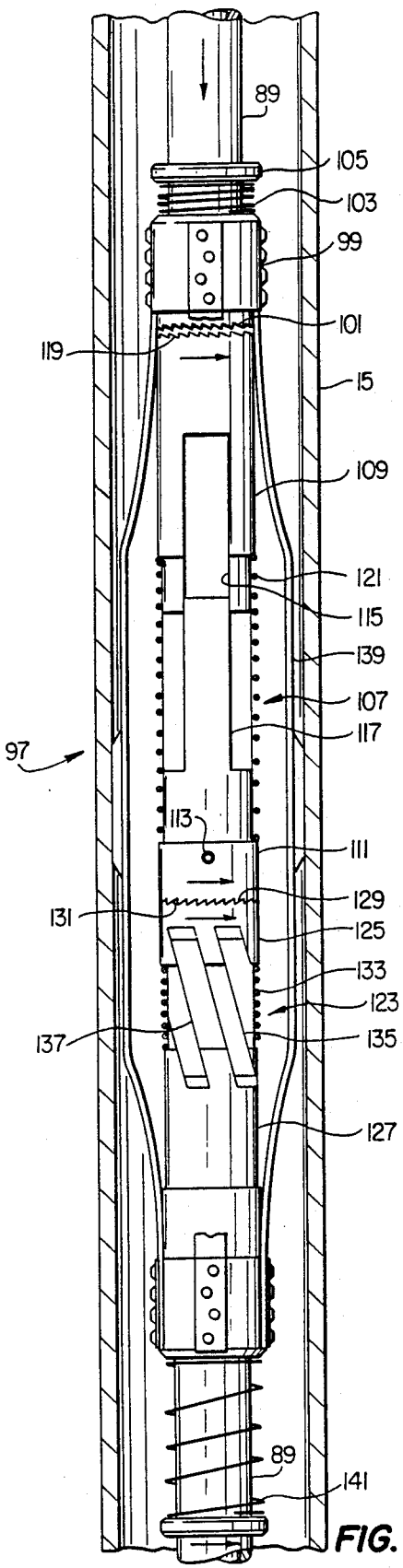
FIGS. 3A and 3B depict the operation of the rotating mechanism of the tool of the present invention.
Figure 3B:
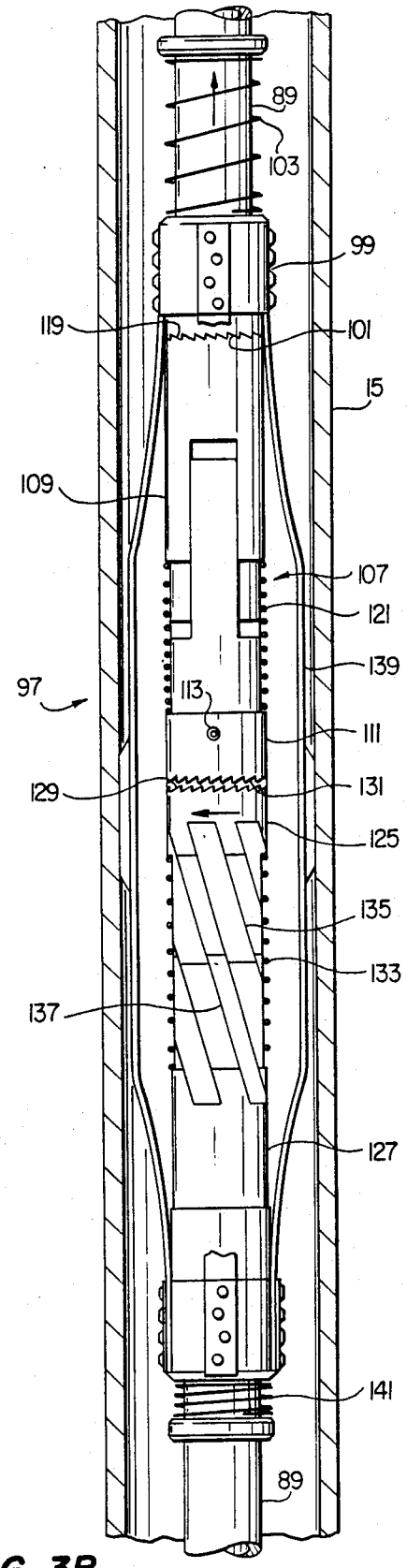

The operation of rotating centralizer assembly 97 can be best understood by reference to FIGS. 3A and 3B. Referring first to FIG. 3A, when second chemical module 89 is moved downwardly within casing 15, by lowering cutting tool 11 on the wireline, such downward movement is resisted by the engagement by bow springs 139 with casing 15. Since ratchet sleeve 99 and second sleeve 127 of helically splined sleeve 123 are movably mounted on chemical module 89, module 89 moves downwardly with respect thereto. On the other hand, since second sleeve 111 of axially splined sleeve assembly 107 is fixedly connected to module 89, it is constrained to move downwardly with module 89. The downward movement of second sleeve 111 meshes ratchet teeth 129 and 131 and causes first sleeve 125 of helically splined sleeve assembly 123 also to move downwardly. The inneraction of splines 135 and 137 produces a torque between sleeves 125 and 127. Since second sleeve 127 of helically splined sleeve assembly 123 is constrained by bow springs 139 not to rotate with respect to casing 15, the torque causes rotation of first sleeve 125 to the right, as shown by the arrow in Referring first to FIG. 3A, when second chemical module 89 is moved downwardly within casing 15, by lowering cutting tool 11 on the wireline, such downward movement is resisted by the engagement by bow springs 139 with casing 15. Since ratchet sleeve 99 and second sleeve 127 of helically splined sleeve 123 are movably mounted on chemical module 89, module 89 moves downwardly with respect thereto. On the other hand, since second sleeve 111 of axially splined sleeve assembly 107 is fixedly connected to module 89, it is constrained to move downwardly with module 89. The downward movement of second sleeve 111 meshes ratchet teeth 129 and 131 and causes first sleeve 125 of helically splined sleeve assembly 123 also to move downwardly. The inneraction of splines 135 and 137 produces a torque between sleeves 125 and 127. Since second sleeve 127 of helically splined sleeve assembly 123 is constrained by bow springs 139 not to rotate with respect to casing 15, the torque causes rotation of first sleeve 125 to the right, as shown by the arrow in FIG. 3A. The rotation of sleeve 125 of helically splined sleeve assembly 123 is transferred through ratchet teeth 129 and 131 to second sleeve 111 of helically splined cell assembly 107. The rightward movement, as shown by the arrow in FIG. 3A, of sleeve 111 is transferred by set screw 113 to cause rotation of chemical module 89.

Referring still to FIG. 3A, spring 121 urges sleeves 109 and 121 of axially splined sleeve assembly 107 axially apart from each other. Sleeves 109 and 111 are constrained by the cooperation of splines 115 and 117 not to rotate with respect to each other and, accordingly, sleeve 109 rotates toward the right, as shown by the arrow in FIG. **3*a*. However, such rightward movement of sleeve 109 is permitted by the disengagement of ratchet teeth 101 and 119. In summary, therefore, a downward movement of tool 11, produces an incremental rightward rotation. It will be recognized of course that when spring 103 is fully compressed, the weight of the tool will cause bow springs 139 to move axially with respect to casing 15**.

Referring now to FIG. 3B, module 89 is shown moved axially upwardly within casing 15. Again, ratchet collar 99 and sleeve 127 of helically splined sleeve assembly 123 are constrained by bow springs 133 not to move axially with respect to casing 15. Thus, module 89 moves axially upwardly with respect to ratchet collar 99 and sleeve 127. Since second sleeve 111 of axially splined sleeve assembly 107 is fixedly connected to module 89 by set screw 113, sleeve 111 moves axially upwardly with respect to ratchet collar 99. The upward movement of sleeve 111 compresses spring 121 which, in turn, urges first sleeve 109 of axially splined sleeve assembly 107 upwardly to mesh ratchet teeth 101 and 119.

The upward movement of second sleeve 111 of axially splined sleeve assembly 107 also permits the upward movement of first sleeve 125 of helically splined sleeve assembly 123 under the influence of spring 133. Since second sleeve 127 is constrained by bow spring 139 not to move, sleeves 125 and 127 move axially apart from each other. Splines 135 and 137 cooperate during such axial movement to produce a torque between sleeves 125 and 127. The torque toward the left, as shown by the arrow in FIG. 3B, on sleeve 125 causes ratchet teeth 129 and 131 to disengage thereby allowing rotation of sleeve 125. Sleeve 127 and ratchet collar 99 are again prevented from rotating by bow springs 139. The engagement of ratchet teeth 109 and 119 prevents axially splined sleeve assembly 107 from rotating, which in turn prevents module 89 from rotating. Again, if module 89 is moved upwardly far enough to fully compress spring 141, rotating centralizer assembly 97 will move upwardly within casing 15. It may thus be seen that module 89, and thus tool 11 may be rotated within casing 15 by moving tool 11 short distances upwardly and downwardly.

Returning now to FIGS. 2F and 2G, the lower end of second chemical module 89 is connected to an igniter sub 45. Igniter sub 145 has a longitudinal bore 147 that is filled with an igniting material such as steel wool. When the cutting fluid from chemical modules 71 and 89 flows through igniter sub 145, it reacts with the igniting material to generate a substantial amount of heat.

The lower end of igniter sub 145 is connected to a decentralizer head assembly 148 which includes a cutting heat 149 and a decentralizer sub 150. Decentralizer head sub assembly 148 has a longitudinal bore 151 which has slidingly mounted therein a head piston 153 and a decentralizer piston 155. A plurality of radial nozzle ports 157 are formed in cuting head 149 to spray hot cutting fluid from longitudinal bore 151 radially outwardly onto the surface of the casing. Nozzle ports 157 are normally sealed by head piston 153. However, when cutting tool 11 is fired, the cutting fluid within bore 147 of igniter sub 145 drives head piston 153 and decentralizer piston 155 downwardly to open nozzle ports 157. Nozzle ports 157 are positioned on only one side of cutting head 149. In the preferred embodiment, nozzle ports 157 cover approximately 180 degrees of the surface of cutting head 149. Thus, the entire volume of cutting fluid is directed toward only a portion of the casing.

Decentralizer sub 150 includes a decentralizer disk 59 positioned diametrically opposite nozzles ports 157. Decentralizer disk 159 is pivotally mounted by means of a pin 161 in a slot 163. Decentralizer disk 159 is normally retained in slot 163 by a shear pin 165. When decentralizer piston 155 is forced downwardly, it contacts decentralizer disk 159 and shears shear pin 165. After shear pin 165 has sheared, decentralizer disk 159 continues to rotate around pin 161 until it reaches the position shown in phantom in FIG. 2G. Decentralizer disk 159 includes a guide way 167 which rides on a pin 169 in slot 163. When cutting tool 11 is retrieved, pin 161 shears and decentralizer disk 159 is suspended on pin 169.

Figure 2H:
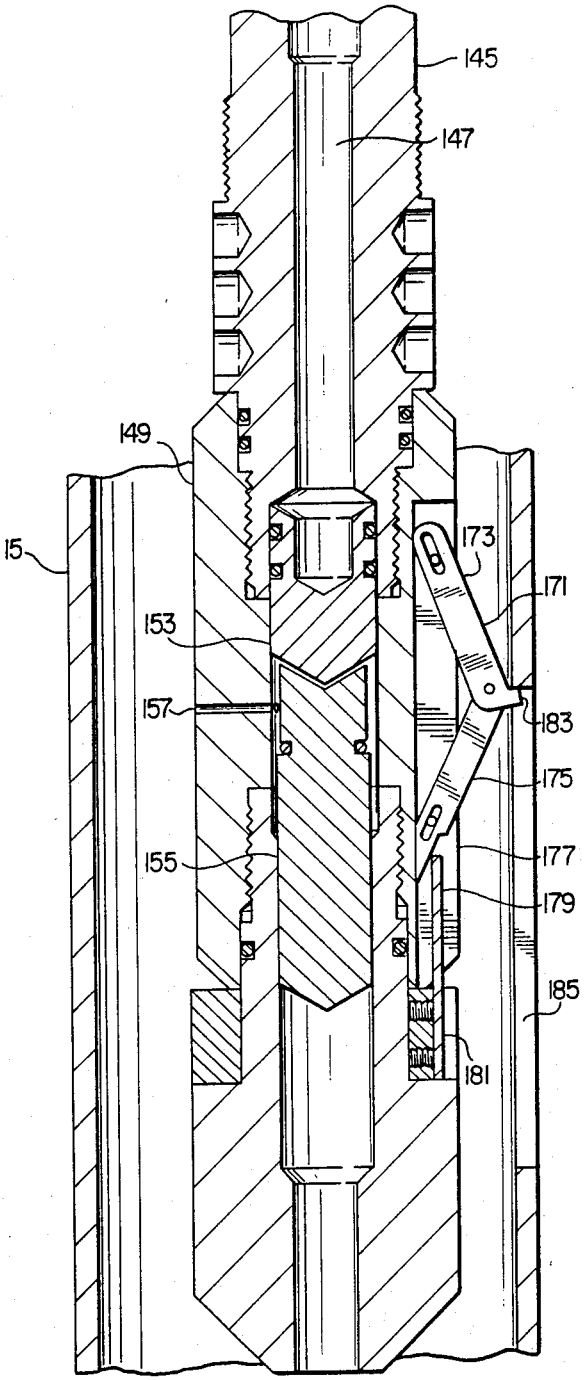
FIG. 2H is a sectional view similar to FIG. 2G showing additional details of the tool of the present invention.

Referring now to FIG. 2H, cutting tool 11 includes means for locating a previously cut section in casing 15. The locating means includes a feeler assembly 171 which includes an arresting arm 173 and a support arm 175. Arresting arm 173 and support arm 175 are movably mounted in a slot 177 formed in cutting head 149. Feeler assembly 171 is normally biased radially outwardly with respect to cutting head 149 by a spring 179 which is supported by a spring mount 181.

Arresting arm 173 includes a finger 183 which is biased into contact with the inner wall of casing 15. Bow springs 139 serve to centralize cutting head 149 in casing 15 to keep finger 183 in contact with casing 15. When finger 183 encounters a previously cut portion 185 of casing 15, finger 183 catches on the upper end of the previously cut portion. The wireline operator can detect the increased force required to raise cutting tool 11 when finger 183 is caught and can thereby determine the location of the previously cut portion. Those skilled in the art will recognize other means for locating the previously cut portion. For example, an electrical switch whose actuation could be sensed up hole could be substituted for the fingers.

Figure 4A:
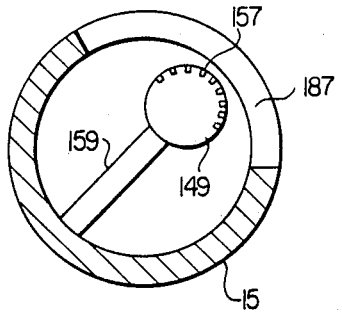
FIGS. 4A–4C depict the operation of the locating and decentral-izing means of the present invention.
Figure 4B:
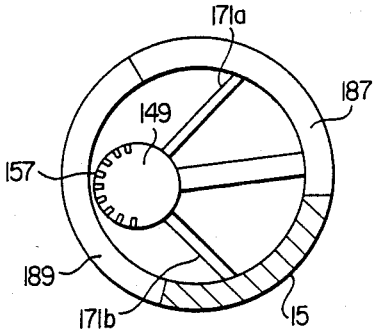
Figure 4C:
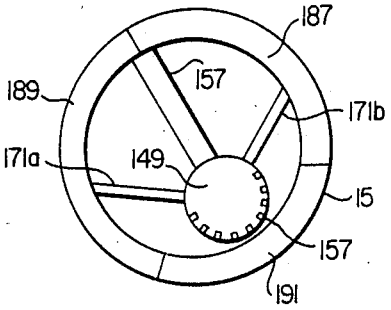

Referring now to FIGS. 4A–4C, there is depicted the sequence of operations in severing casing 15. In FIG. 4A, a sector 187 has just been cut from casing 15. Cutting head 149 is decentralized by decentralizer disk 159 toward sector 187 and nozzles 157 have discharged their cutting fluid. It will be noted that the tool depicted in FIG. 4A does not include feeler assembly 171; on the initial cut of casing 15, the locator means is unnecessary.

In FIG. 4B, there is shown the configuration of the tool after it has cut a second sector 189 from casing 15. Cutting head 149 includes two feeler assemblies 171A and 1B. Feeler assembly 171a has located first sector 187, thereby positioning the nozzles 157 of cutting head 149 toward second sector 187. Decentralizer disk 159 has positioned nozzles 157 adjacent second sector 189 and the nozzles have discharged their cutting fluid.

Finally, in FIG. 4C there is depicted the configuration of the tool immediately after it has cut a third sector 191 to completely sever casing 15. Feeler assemblies 171A and 171B have located previously cut sectors 189 and 187, respectively, to position nozzles 157 of cutting head 149 toward third sector 191. Decentralizer disk 159 has positioned cutting head 149 adjacent sector 191 and the nozzles have discharged their cutting fluid.

It is thus seen that the apparatus and method of the present invention are well adapted for cutting large diameter thick walled tubular members. The tool is run into the tubular member where it makes a first cut of a portion of the tubular member's wall. The tool is then removed from the tubular member and then the same or another similar tool is run back into the tubular member to locate the previously cut portion of the tubular member and cut a second portion of the tubular member. The process is repeated until the tubular member is severed.

Further modifications and alternative embodiments of the apparatus and method of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the size, shape and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. A method of cutting a tubular member comprising the steps of:

running a first cutting head into said tubular member to a selected axial position;

discharging a first quantity of cutting fluid from said first cutting head;

withdrawing said first cutting head from said tubular member;

running a second cutting head into said tubular member to said axial position of the tubular member cut by the discharge of said first quantity of cutting fluid;

rotating said second cutting head; and discharging a second quantity of cutting fluid from said second cutting head onto a portion of said tubular member other than the postion onto which said first quantity of cutting fluid was discharged.

2. Apparatus for cutting a tubular member comprising:

a tool body adapted to be inserted in said tubular member;

means for anchoring said tool body in said tubular member;

a cutting head movably connected to said tool body, said cutting head including at least one nozzle;

decentralizer means for positioning said at least one nozzle adjacent a portion of said tubular member;

means for discharging a quantity of cutting fluid from said at least one nozzle to cut a portion of said tubular member; and means for orienting said at least one nozzle circumferentially with respect to a a previously cut portion of said tubular member, said orienting means including means for rotating said cutting head within said tubular member and means for locating said previously cut portion.

3. Apparatus for causing a tubular member according to claim 2, wherein said locating means includes;

a feeler member extending outwardly from said cutting head circumferentially spaced apart from said at least one nozzle, said feeler member being engagable with said previously cut portion.

4. Apparatus for cutting a tubular member according to claim 3, wherein said rotating means includes:

a collar moveably mounted on said cutting head;

means connected to said collar for engaging said tubular member to resist axial and rotational movement of said collar with respect to said tubular member; and means for translating axial movement of said cutting head with respect to said collar into rotational movement of said cutting head with respect to said collar.

5. Apparatus for cutting a tubular member according to claim 4, wherein said collar includes a plurality of ratchet teeth, and said translating means includes:

an axially splined sleeve assembly including a first sleeve movable mounting on said cutting head and a second sleeve fixedly mounted on said cutting head, said first sleeve of said axially splined sleeve assembly including a plurality of ratchet teeth engagable with said ratchet teeth of said collar, said second sleeve of said axially splined sleeve assembly including a plurality of ratchet teeth, said first and second sleeve of said axially splined sleeve assembly including mutually engaging axial splines;

means for urging said first sleeve of said axially splined sleeve assembly toward said collar to mesh the respective ratchet teeth of said collar and first sleeve of said axially splined sleeve assembly;

a helically splined sleeve assembly including a first sleeve movably mounted on said cutting head and a second sleeve movably mounted on said cutting head, said first sleeve of said helically splined sleeve assembly including a plurality of ratchet teeth engagable with said ratchet teeth of said second sleeve of said axially splined sleeve assembly, said first and second sleeve of said helically splined sleeve assembly including mutually engaging helical splines; and means for urging said first sleeve of said helically splined sleeve assembly toward said second sleeve of said axially splined sleeve assembly to mesh the respective ratchet teeth of said first sleeve of said helically splined sleeve assembly and said second sleeve of said axially splined sleeve assembly.

6. Apparatus for cutting a tubular member according to claim 5, wherein said means for engaging said tubular member includes:

a plurality of bow springs connected between said collar and said second sleeve of said helically splined sleeve assembly.

7. Apparatus for cutting a tubular member according to claim 4, wherein said translating means includes a helically splined sleeve assembly including a first sleeve moveably mounted on said cutting head and a second sleeve moveably mounted on said cutting head, said first and second sleeves of said helically splined sleeve assembly including mutually engaging helical splines, and means for coupling said helically splined sleeve assembly to said cutting head when said cutting head is moved in one axial direction.

8. Apparatus for cutting a tubular member according to claim 4, wherein said first sleeve of helically splined sleeve assembly includes a plurality of ratchet teeth and said coupling means includes a ratchet sleeve fixedly mounted on said cutting head, said ratchet sleeve having a first plurality of ratchet teeth at one of its ends engagable with said ratchet teeth of said first sleeve of said helically splined sleeve assembly.

9. Apparatus for cutting a tubular member according to claim 8, wherein said collar includes a plurality of ratchet teeth and said ratchet sleeve includes a second plurality of ratchet teeth at its other end engagable with said ratchet teeth of said collar.

10. Apparatus for cutting a tubular member according to claim 9, wherein said means for engaging said tubular member includes a plurality of bow springs connected between said collar and said second portion of said helically splined sleeve assembly.

11. Apparatus for cutting a tubular member according to claim 9, wherein said ratchet sleeve includes a first axially splined sleeve fixedly mounted on said cutting head and a second axially splined sleeves axially slidingly mounted on said cutting head said first and second axially splined sleeve including mutually engaged axial splines.

12. Apparatus for cutting a tubular member comprising:

a cutting head adapted to be inserted in said tubular member, said cutting head including at least one nozzle;

means for orienting said at least one nozzle circumferentially with respect to a previously cut sector of said tubular member, said orienting means including means for rotating said cutting head within said tubular member and means for locating said previously cut sector;

decentralizer means for positioning said at least one nozzle radially adjacent a portion of said tubular member; and means for discharging a quantity of cutting fluid from said at least one nozzle to cut said portion of said tubular member other than said previously cut sector.

13. Apparatus for cutting a tubular member according to claim 12, herein said locating means includes:

a feeler member extending outwardly of said cutting head circumferentially spaced apart from said at least one nozzle, said feeler member being engageable with said previously cut portion.

14. Apparatus for cutting a tubular member according to claim 12, wherein said rotating means includes:

a collar moveably mounted on said cutting head;

means connected to said collar for engaging said tubular member to resist axial and rotational movement of said collar with respect to said tubular member; and means for translating axial movement of said cutting head with respect to said collar into rotational movement of said cutting head with respect to said collar.

15. Apparatus for cutting a tubular member according to claim 14, wherein said collar includes a plurality of ratchet teeth, and said translating means includes;

an axially splined sleeve assembly including a first sleeve moveably mounted on said cutting head and a second sleeve fixedly mounted on said cutting head, said first sleeve of said axially splined sleeve assembly including a plurality of ratchet teeth engagable with said ratchet teeth of said collar, said second sleeve of said axially splined sleeve assembly including a plurality of ratchet teeth, said first and second sleeve of said axially splined member including mutually engaging axial splines;

means for urging said first sleeve of said axially splined member toward said collar to mesh with the respect ratchet teeth of said collar and first sleeve of said axially splined sleeve assembly;

a helically splined sleeve assembly including a first sleeve moveably mounted on said cutting head and a second sleeve moveably mounted on said cutting head, said first sleeve of said helically splined sleeve assembly including a plurality of ratchet teeth engageable with said ratchet teeth of said second sleeve of said axially splined sleeve assembly, said first and second sleeves of said helically splined sleeve assembly including mutually engaging helical splines; and means for urging said first sleeve of said helically splined sleeve assembly toward said second sleeve of said axially splined sleeve assembly to mesh the respective ratchet teeth of said first sleeve of said helically splined sleeve assembly and said second sleeve of said axially splined sleeve assembly.

16. Apparatus for cutting a tubular member according to claim 15, wherein said means engaging said tubular member includes:

a plurality of bow springs connected between said collar and said second sleeve of said helically splined sleeve assembly.

17. Apparatus for cutting a tubular member according 14, wherein said translating means includes a helically splined sleeve assembly including a first sleeve moveably mounted on said cutting head and a second sleeve moveably mounted on said cutting head, said first and second sleeves of said helically splined sleeve assembly including mutually engaging helical splines, and means for coupling said helically splined sleeve to said cutting head when said cutting head is moved in one axial direction.

18. Apparatus for cutting a tubular member according to claim 17, wherein said first of said helically splined sleeve assembly includes a plurality of ratchet teeth and said coupling means includes a ratchet sleeve nonrotatingly mounted on said cutting head, said ratchet sleeve having a first plurality of ratchet teeth at one end of its ends engageable with said ratchet teeth of said first sleeve of said helically splined sleeve assembly.

19. Apparatus for cutting a tubular member according to claim 18, wherein said collar includes a plurality of ratchet teeth and said ratchet sleeve includes a second plurality of ratchet teeth at its other end engageable with said ratchet teeth of said collar.

20. Apparatus for cutting a tubular member according to claim 19, wherein said means for engaging said tubular member includes a plurality of bow springs connected between said collar and said second sleeve of said axially splined sleeve assembly.

21. Apparatus for cutting a tubular member according to claim 19, wherein said ratchet sleeve includes a first axially splined sleeve fixedly mounted on said cutting head and a second axially splined sleeve axially slidingly mounted on said cutting head, said first and second axially splined sleeves including mutually engaged axial splines.

* * * * *